US007199680B2

(12) United States Patent
Fukunaga

(10) Patent No.: US 7,199,680 B2
(45) Date of Patent: Apr. 3, 2007

(54) RF MODULE USING MODE CONVERTING STRUCTURE HAVING SHORT-CIRCUITING WAVEGUIDES AND CONNECTING WINDOWS

(75) Inventor: Tatsuya Fukunaga, Chuo-ku (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 10/692,823

(22) Filed: Oct. 27, 2003

(65) Prior Publication Data

US 2004/0085153 A1 May 6, 2004

(30) Foreign Application Priority Data

Oct. 29, 2002 (JP) ..... 2002-313853

(51) Int. Cl.
*H01P 5/107* (2006.01)

(52) U.S. Cl. ..... 333/26; 333/248

(58) Field of Classification Search ..... 333/21 R, 333/26, 248

See application file for complete search history.

(56) References Cited

U.S. PATENT DOCUMENTS

| | | | | |
|---|---|---|---|---|
| 5,982,256 | A * | 11/1999 | Uchimura et al. | 333/239 |
| 6,002,305 | A * | 12/1999 | Sanford et al. | 333/26 |
| 6,081,241 | A | 6/2000 | Josefsson et al. | |
| 6,380,825 | B1 * | 4/2002 | Takenoshita et al. | 333/137 |

FOREIGN PATENT DOCUMENTS

| | | |
|---|---|---|
| EP | 1 014 471 A1 | 6/2000 |
| JP | A 6-53711 | 2/1994 |
| JP | A-10-107518 | 4/1998 |
| JP | A-10-303333 | 11/1998 |
| JP | A-11-19170 | 7/1999 |
| JP | A 11-284409 | 10/1999 |
| JP | A 2000-216605 | 8/2000 |
| JP | A-2000-252712 | 9/2000 |
| JP | A 2002-135003 | 5/2002 |
| JP | A 2003-110307 | 4/2003 |

OTHER PUBLICATIONS

Herman et al., "Novel Techniques for Millimeter-Wave Packages," IEEE Transactions on Microwave Theory and Techniques, vol. 43, No. 7, Jul. 1995, pp. 1516-1523.

* cited by examiner

*Primary Examiner*—Benny Lee
(74) *Attorney, Agent, or Firm*—Oliff & Berridge, PLC

(57) ABSTRACT

The present invention is directed to enable mode conversion between a TEM mode and another mode to be performed among a plurality of waveguides. An RF module comprises: a TEM waveguide as a first waveguide for propagating electromagnetic waves in a TEM mode; and a waveguide having a multilayer structure as a second waveguide connected to the first waveguide, for propagating electromagnetic waves in another mode different from the TEM mode. An end of the first waveguide is directly conductively connected to one of ground electrodes of the second waveguide from the stacking direction side of the ground electrodes. Since magnetic fields are coupled so that the direction of the magnetic field of the first waveguide and that of the magnetic field of the second waveguide match with each other in the H plane, mode conversion between the TEM mode and another mode can be excellently performed between the waveguides.

5 Claims, 18 Drawing Sheets

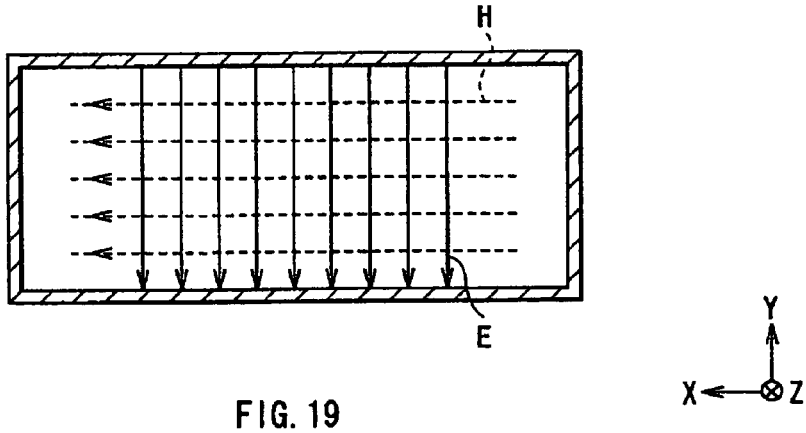
FIG. 19
RELATED ART
FIG. 20A
RELATED ART
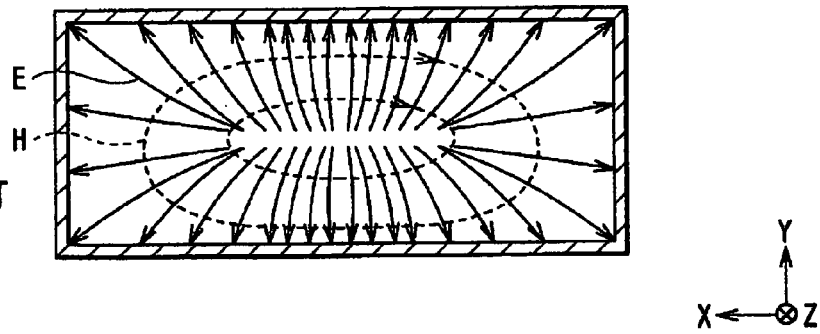
FIG. 20B
RELATED ART
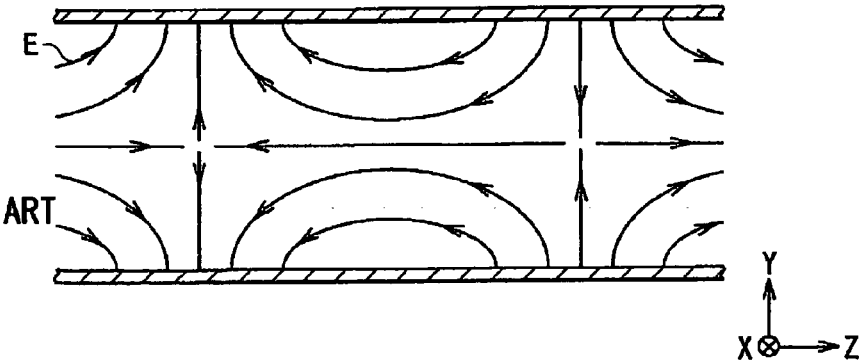

RF MODULE USING MODE CONVERTING STRUCTURE HAVING SHORT-CIRCUITING WAVEGUIDES AND CONNECTING WINDOWS

BACKGROUND

The present invention relates to an RF module used for propagating a signal in a high frequency band of microwaves, millimeter waves, or the like and a mode converting structure and method for converting a mode between different waveguides.

Conventionally, as transmission lines for transmitting a high frequency signal in a microwave band, a millimeter wave band, and the like, a strip line, a microstrip line, a coaxial line, a waveguide, a dielectric waveguide, and the like are known. Each of them is also known as a component of a resonator and a filter for high frequency signal. An example of a module formed by using any of the components for high frequency is an MMIC (Monolithic Microwave IC). Hereinbelow, a transmission line for high frequency, and a microstrip line, a waveguide, or the like each serving as a component of a filter or the like will be generically called waveguides.

Propagation modes of electromagnetic waves in a waveguide will now be described. FIGS. 18A and 18B show an electric field distribution and a magnetic field distribution, respectively, in a state called a TE mode ($TE_{10}$ mode) in a rectangular waveguide. The positions of sections S1, S2, S3, S4 and S5 in FIG. 18A and those in FIG. 18B correspond to each other. FIG. 19 shows an electromagnetic distribution in the section S1. As shown in the diagrams, a state in which electric field components exist only in the section direction, and electric field components do not exist in an electromagnetic wave travel direction (waveguide axial direction) Z is called the "TE mode".

FIGS. 20A and 20B show electromagnetic field distributions in a state called a TM mode ($TM_{11}$ mode). FIG. 20A shows an electromagnetic field distribution in an XY section orthogonal to the waveguide axial direction Z, and FIG. 20B shows an electromagnetic field distribution in a YZ section of a side face. As shown in the diagrams, a state in which magnetic field components exist only in the section direction and no magnetic field components exist in the electromagnetic wave travel direction Z is called the "TM mode".

In each of the modes, a plane parallel to an electric field E is called an "E plane" and a plane parallel to a magnetic field H is called an "H plane". In the examples of the TE mode of FIGS. 18A and 18B, a plane parallel to the XY plane is the E plane, and a plane parallel to the XZ plane is the H plane.

In a microstrip line, a coaxial line, or the like shown in FIGS. 21A and 21B, a state called a TEM mode exists. The microstrip line is obtained by, as shown in FIG. 21A, disposing a ground (earth) conductor 101 and a line pattern 103 made of a conductor having a line shape so as to face each other while sandwiching a dielectric 102. The coaxial line is obtained by, as shown in FIG. 21B, surrounding a central conductor 111 by a cylindrical ground conductor 112.

FIGS. 22A and 22B show electromagnetic field distributions in the TEM mode in the microstrip line and the coaxial line, respectively. A state in which, as shown in the diagrams, both of the electric field components and the magnetic field components exist only in sections and do not exist in the electromagnetic wave travel direction Z is called a "TEM mode".

In an RF module having a plurality of waveguides, a structure for mutually coupling the waveguides is necessary. In particular, in the case of coupling waveguides of different modes, a structure for performing mode conversion among the waveguides is required.

Conventionally, an example of known structures of connecting a microstrip line and a waveguide is that, as shown in FIG. 23, a ridge 121 is provided in the center of the waveguide. The line pattern 103 of the microstrip line is inserted in a portion where the ridge 121 is provided. In this case, assuming that the microstrip line is in the TEM mode and the ridge waveguide is in the TE mode, the electric field distribution in the microstrip line is as show in FIG. 24A, and that in the ridge 121 is as shown in FIG. 24B. In a connection portion, by combining both of the electric field distributions, mode conversion is performed between the microstrip line and the ridge waveguide.

Recently, there is a known structure in which a dielectric waveguide line is formed by a stacking technique in a wiring board of a multilayer structure. The structure has a plurality of ground conductors stacked while sandwiching dielectrics and through holes of which inner faces are metalized to make the ground conductors conductive, and electromagnetic waves are propagated in a region surrounded by the ground conductors and through holes. A structure in which the waveguide having the multilayer structure is connected to a microstrip line is disclosed in, for example, Japanese Unexamined Patent Publication No. 2000-216605. The structure disclosed in this publication is basically similar to the structure using a ridge waveguide. In a center portion of the waveguide, a ridge is falsely formed in a step shape by using the through hole.

Another example of the structure of connecting waveguides of different kinds is that an input/output terminal electrode is provided in an end portion of a base of a dielectric resonator, and the input/output terminal electrode is connected to a line pattern on a printed board (Japanese Unexamined Patent Publication No. 2002-135003).

Conventionally, some structures of connecting different waveguides are known as described above. On the other hand, the waveguide having the multilayer structure is a relatively new technique, and the structure of connecting different waveguides has not been developed sufficiently. In particular, in the case of connecting a waveguide in the TEM mode and a waveguide having the multilayer structure, the converting structure for properly converting the mode among the waveguides has room for improvement.

SUMMARY

The present invention has been achieved in consideration of such problems and its object is to provide an RF module and a mode converting structure and method capable of excellently performing mode conversion between a TEM mode and another mode among a plurality of waveguides.

An RF module according to the invention comprises: a first waveguide for propagating electromagnetic waves in a TEM mode; and a second waveguide connected to the first waveguide, for propagating electromagnetic waves in another mode different from the TEM mode. The second waveguide has a region surrounded by at least two ground electrodes facing each other and conductors for bringing at least two ground electrodes into conduction, and electromagnetic waves propagate in the region. The first waveguide extends in a stacking direction of the ground electrodes, and an end of the first waveguide is directly conductively connected to one of the ground electrodes of the second waveguide from the stacking direction side. Magnetic fields of the first and second waveguides are coupled in an H plane of the second waveguide so that the direction of the magnetic field of electromagnetic waves propagated in the first waveguide and that of the magnetic field of electromagnetic waves propagated in the second waveguide match with each other.

According to the invention, there is provided a mode converting structure for converting a mode between different waveguides of; a first waveguide for propagating electromagnetic waves in a TEM mode, and a second waveguide connected to the first waveguide, for propagating electromagnetic waves in another mode different from the TEM mode, wherein the second waveguide has a region surrounded by at least two ground electrodes facing each other and conductors for bringing at least two ground electrodes into conduction, electromagnetic waves propagate in the region, the first waveguide extends in a stacking direction of the ground electrodes, an end of the first waveguide is directly conductively connected to one of the ground electrodes of the second waveguide from the stacking direction side, and magnetic fields of the first and second waveguides are coupled in an H plane of the second waveguide so that the direction of the magnetic field of electromagnetic waves propagated in the first waveguide and that of the magnetic field of electromagnetic waves propagated in the second waveguide match with each other.

According to the invention, there is also provided a method for converting a mode in a structure comprising: a first waveguide for propagating electromagnetic waves in a TEM mode; and a second waveguide connected to the first waveguide, for propagating electromagnetic waves in another mode different from the TEM mode, the second waveguide having a region surrounded by at least two ground electrodes facing each other and conductors for bringing at least two ground electrodes into conduction, and electromagnetic waves propagating in the region, wherein the first waveguide extends in a stacking direction of the ground electrodes, an end of the first waveguide is directly conductively connected to one of the ground electrodes of the second waveguide from the stacking direction side, and magnetic fields of the first and second waveguides are coupled in an H plane of the second waveguide so that the direction of the magnetic field of electromagnetic waves propagated in the first waveguide and that of the magnetic field of electromagnetic waves propagated in the second waveguide match with each other.

In the RF module and the mode converting structure and method according to the invention, a first waveguide propagates electromagnetic waves in a TEM mode. In a second waveguide, electromagnetic waves in another mode different from the TEM mode propagate in a region surrounded by at least two ground electrodes facing each other and conductors for bringing at least two ground electrodes into conduction. An end of the first waveguide is directly conductively connected to one of the ground electrodes of the second waveguide from the stacking direction side. Magnetic fields of the first and second waveguides are coupled in an H plane of the second waveguide so that the direction of the magnetic field of electromagnetic waves propagated in the first waveguide and that of the magnetic field of electromagnetic waves propagated in the second waveguide match with each other. In such a manner, in the connecting portion between the first and second waveguides, mode conversion between the TEM mode and another mode is performed.

The RF module according to the invention may have a configuration such that a window formed by partially opening the ground electrode in a connection portion between the first and second waveguides.

The RF module according to the invention may also have a configuration such that the second waveguide has a structure having a plurality of propagation regions for propagating electromagnetic waves in different directions, and a magnetic field from an end portion of the first waveguide is coupled in a boundary portion of the plurality of propagation regions in the second waveguide.

In this case, a magnetic field from an end portion of the first waveguide may be connected in a boundary portion of the plurality of propagation regions in the second waveguide so that electromagnetic waves propagated through the first waveguide propagate so as to be branched into the plurality of propagation regions in the second waveguide.

Other and further objects, features and advantages of the invention will appear more fully from the following description.

BRIEF DESCRIPTION OF THE DRAWINGS

FIG. 19 is a diagram showing an electromagnetic field distribution in an E plane in the waveguide in the TE mode.

FIGS. 20A and 20B are diagrams each illustrating an electromagnetic field distribution in the waveguide in the TM mode.

DETAILED DESCRIPTION OF THE PREFERRED EMBODIMENTS

Embodiments of the invention will now be described in detail hereinbelow with reference to the drawings, where like features appearing in different drawings are denoted by like referenced numerals and may not be described in detail for all drawing figures in which they appear.

Figure 1:
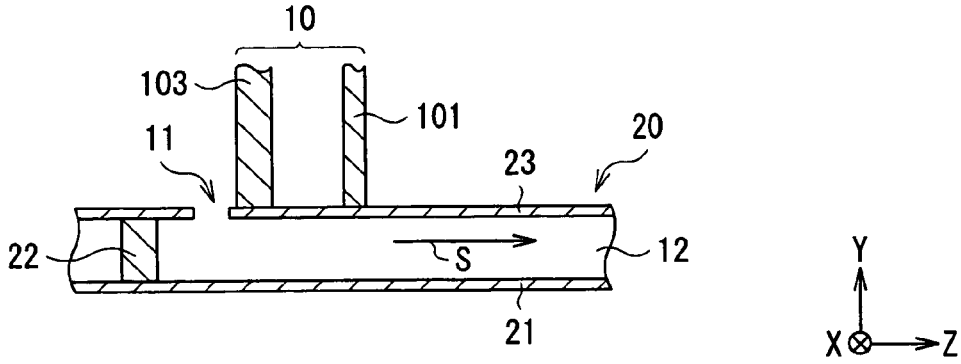
FIG. 1 is a cross section showing an example of the configuration of an RF module according to an embodiment of the invention.
Figure 2:
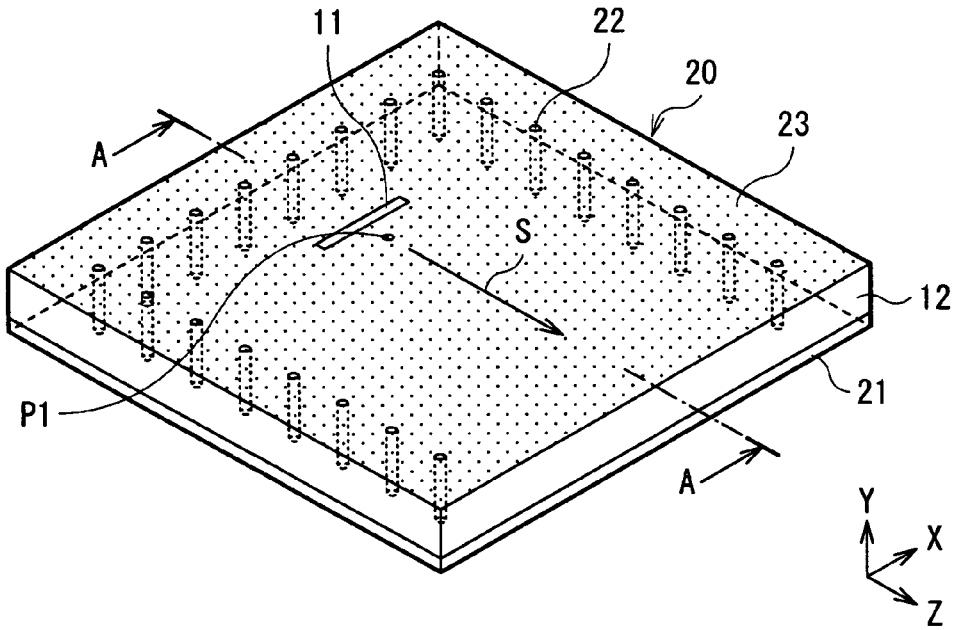
FIG. 2 is a perspective view of the RF module shown in FIG. 1.
Figure 3:
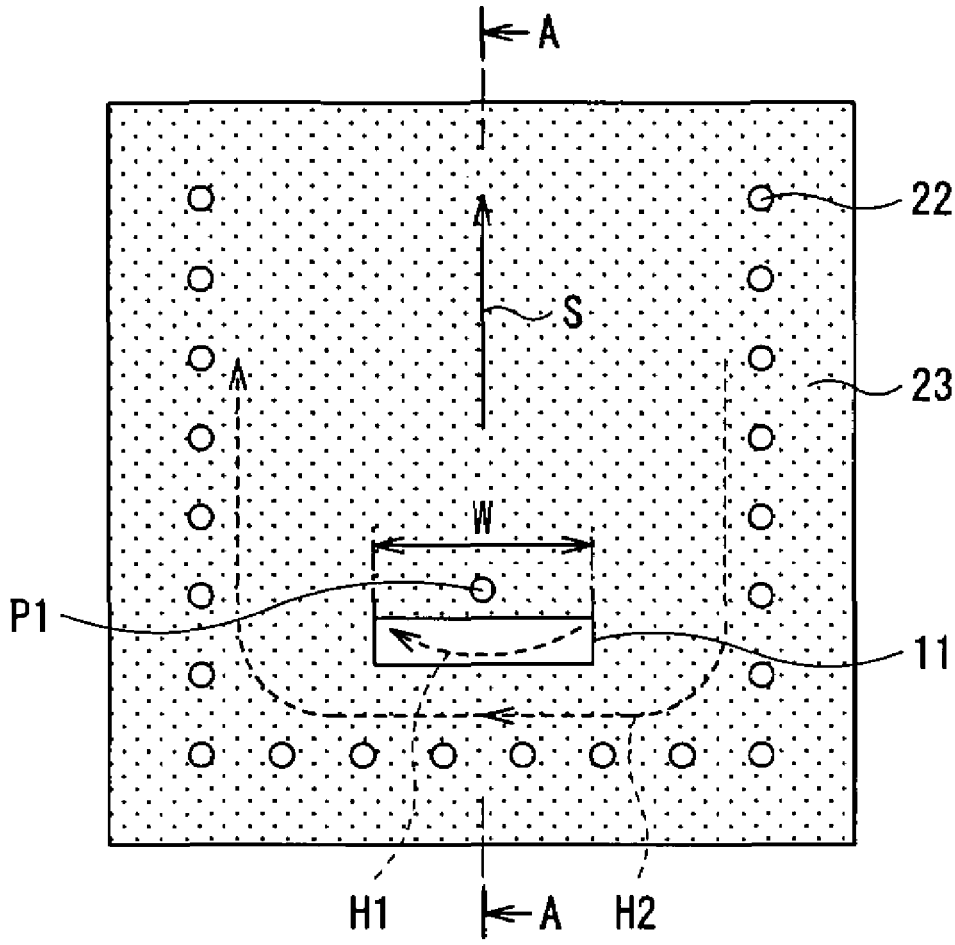
FIG. 3 is a plan view of the RF module shown in FIG. 1.

FIGS. 1, 2 and 3 show a first example of the configuration of an RF module according to an embodiment of the invention. FIG. 1 corresponds to a section taken along line A—A of FIGS. 2 and 3. In FIG. 3, for simplicity of the drawing, the thickness of the uppermost layer is omitted and the uppermost layer is hatched. The RF module has a structure of conversion between the TEM mode and another mode and can be used for, for example, a transmission line for RF signals, a filter, and the like. The RF module has a waveguide 10 (FIG. 1) capable of propagating electromagnetic waves in the TEM mode (hereinbelow, called a TEM waveguide) and a multilayer-structured waveguide 20 (FIGS. 1 and 2) which is connected to the TEM waveguide 10 and propagates electromagnetic waves in a mode different from the TEM mode. In the configuration example, the TEM waveguide 10 corresponds to a concrete example of a "first waveguide" in the invention, and the waveguide 20 corresponds to a concrete example of a "second waveguide" in the invention.

The waveguide 20 has ground electrodes 21 and 23 which face each other while sandwiching a dielectric substrate 12 (FIGS. 1 and 2) and a plurality of through holes 22 as conductors for bringing the ground electrodes 21 and 23 into conduction. In the waveguide 20, electromagnetic waves propagate, for example, in an S direction in the diagram in a region surrounded by the ground electrodes 21 and 23 and the through holes 22. The waveguide 20 may have a configuration of a dielectric waveguide in which the electromagnetic wave propagation region is filled with a dielectric or a configuration of a cavity waveguide having therein a cavity. The through holes 22 are provided at intervals of a certain value or less (for example, ¼ of a signal wavelength or less) so that the propagating electromagnetic waves are not leaked. The inner face of the through hole 22 is metalized. The sectional shape of the through hole 22 is not limited to a circular shape but may be another shape such as a polygon shape or an oval shape.

In the waveguide 20, near a position P1 of connection to the TEM waveguide 10, a coupling window 11 for adjusting coupling with the TEM waveguide 10 is provided. In the example of the drawing, the coupling window 11 is provided in the upper ground electrode 23 and the TEM waveguide 10 is coupled near the coupling window 11. The coupling window 11 is formed by partially cutting the ground electrode 23, for example, in a rectangular shape. It is also possible to provide the coupling window 11 in the lower ground electrode 21 and couple the TEM waveguide 10 to the lower ground electrode 21 side. The connection position P1 may be provided on the side opposite to the position shown in the diagram with respect to the coupling window 11 (symmetrically opposite side). Specifically, in the example of the drawing, the connection position P1 is on the inner side of the waveguide 20 when seen from the coupling window 11. The connection position P1 may be on the outer side (peripheral side) when seen from the coupling window 11.

The TEM waveguide 10 is a waveguide such as a microstrip line or a coaxial line and is not particularly limited as long as it can propagate electromagnetic waves in the TEM mode. The TEM waveguide 10, which includes a ground conductor 101 and a line pattern 103, extends in a stacking direction (Y direction) of the ground electrodes 21 and 23 of the waveguide 20, and its end portion is directly connected to the ground electrode 23 as one of the ground electrodes from the stacking direction side and is made conductive. The magnetic field of the TEM waveguide 10 is magnetic field connected in an H plane (plane parallel to the magnetic field) of the waveguide 20. When the waveguide 20 is in the TE mode and the travel direction S of the electromagnetic waves is the Z direction in FIG. 1, the H plane of the waveguide 20 is parallel to an XZ plane of the diagram.

In the RF module, the magnetic field distributions in the connection portion between the TEM waveguide 10 and the waveguide 20 and in the H plane near the connection portion are schematically as shown in FIG. 3. Since the TEM waveguide 10 is in the TEM mode, its magnetic fields are distributed circularly around the TEM waveguide 10. Near the connection portion, however, since the end portion is in conductive relationship with the ground electrode 23, a magnetic field H1 of the TEM waveguide 10 is distributed mainly near the coupling window 11 provided around the connection portion. On the other hand, for example, in a TE mode of the lowest order ($TE_{10}$ mode), a magnetic field H2 of the waveguide 20 is distributed spirally along the wall in the H plane. Therefore, as shown in the diagram, by matching the direction of the magnetic field H1 in the coupling window 11 of the TEM waveguide 10 and the direction of the magnetic field H2 of the waveguide 20 in the H plane of the waveguide 20, the magnetic fields are coupled near the coupling window 11, thereby making conversion from the TEM mode to the TE mode.

Figure 6:
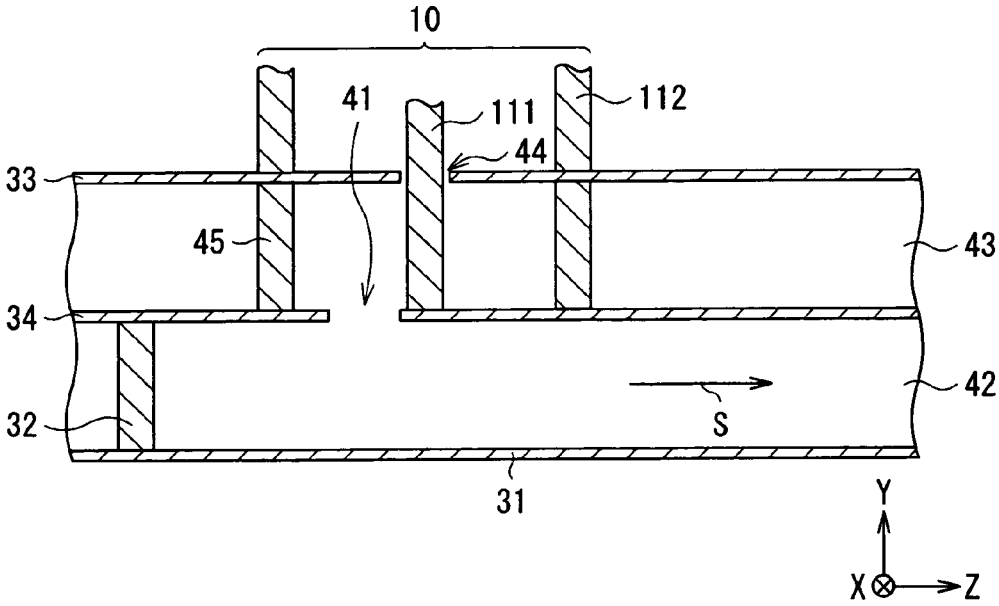
FIG. 6 is a cross section showing another example of the configuration of an RF module according to an embodiment of the invention.
Figure 7:
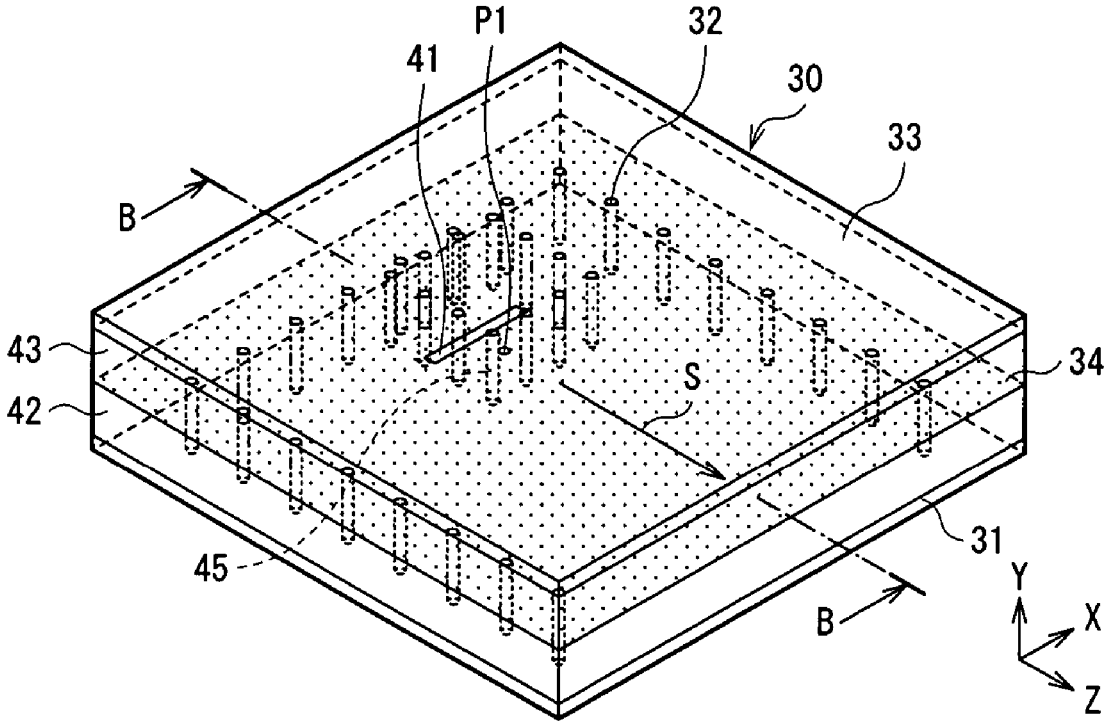
FIG. 7 is a perspective view of the RF module shown in FIG. 6.
Figure 8:
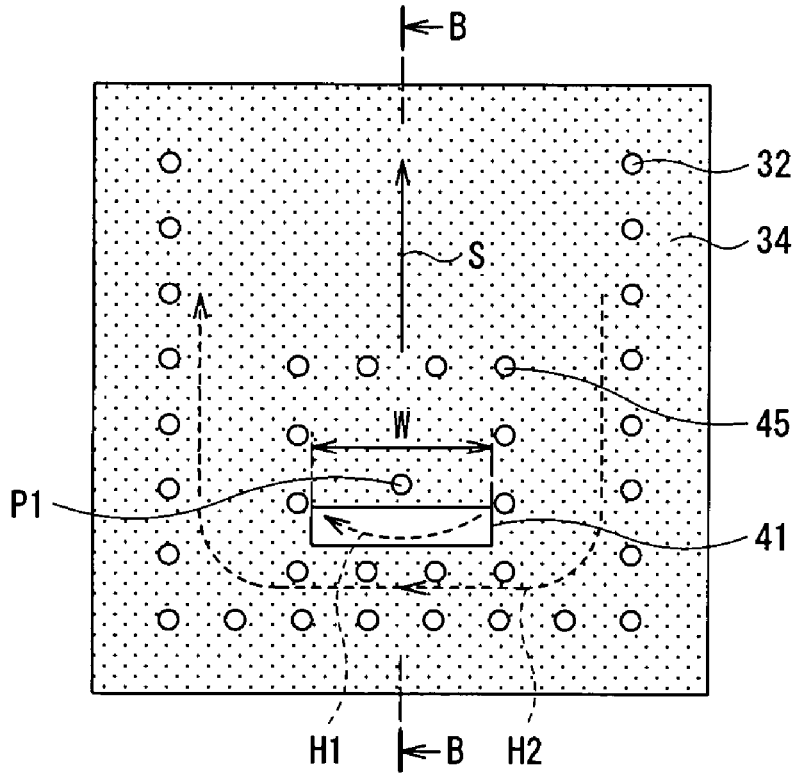
FIG. 8 is a plan view of an intermediate layer in the RF module shown in FIG. 6.

FIGS. 6, 7 and 8 show a second configuration example of the RF module according to the embodiment of the invention. FIG. 6 corresponds to a section taken along line B—B of FIGS. 7 and 8. In FIG. 7, to simplify the drawing, the thickness of an intermediate layer is omitted and the intermediate layer is hatched. The RF module has, like the RF module shown in FIGS. 1, 2 and 3, a structure of conversion between the TEM mode and another mode. The RF module is different from the RF module shown in FIGS. 1, 2 and 3 with respect to the portion of the waveguide 30. In the configuration example, the waveguide 30 corresponds to a concrete example of the "second waveguide" in the invention.

The waveguide 30 has two dielectric substrates 42 and 43, three ground electrodes 31, 33, and 34 provided on the dielectric substrates 42 and 43 so as to face each other, and a plurality of through holes 32 and 45 as conductors each for bringing at least two of the ground electrodes 31, 33, and 34 into conduction. The lower ground electrode 31 is uniformly provided on the bottom face of the lower dielectric substrate 42. The upper ground electrode 33 is uniformly provided on the top face of the upper dielectric substrate 43. The intermediate ground electrode 34 is provided between the dielectric substrates 42 and 43.

The through holes 32 and 45 are provided at intervals of a certain value or less (for example, ¼ of the signal wavelength or less) so that the propagating electromagnetic waves are not leaked. The inner face of each of the through holes 32 and 45 is metalized. The sectional shape of each of the through holes 32 and 45 is not limited to a circular shape but may be another shape such as a polygon shape or an oval shape. The through hole 45 brings the upper ground electrode 33 and the intermediate ground electrode 34 into conduction. The through hole 32 brings the lower ground electrode 31 and the intermediate ground electrode 34 into conduction. The through holes 45 are disposed so as to surround the position P1 of connection to the TEM waveguide 10.

In the waveguide 30, in a region surrounded by the lower ground electrode 31, intermediate ground electrode 34, and through holes 32, electromagnetic waves propagate, for example, in the S direction in the drawing. The waveguide 30 may have a configuration of a dielectric waveguide in which the electromagnetic wave propagation region is filled with a dielectric or a configuration of a cavity waveguide having therein a cavity.

In the configuration example, the TEM waveguide 10, which includes a central conductor 111 and a cylindrical ground conductor 112, extends in the stacking direction (Y direction) of the ground electrodes 31, 33, and 34 of the waveguide 30 and its end portion, which includes the central conductor 111, is directly connected to the intermediate ground electrode 34 from the stacking direction side via the upper ground electrode 33 and is made conductive. In the upper ground electrode 33, an insertion hole 44 in which the TEM waveguide 10 is inserted is provided. In the intermediate ground electrode 34, a coupling window 41 for adjusting coupling is provided near the position P1 of connection to the TEM waveguide 10. The coupling window 41 is formed by partially cutting the intermediate ground electrode 34, for example, in a rectangular shape. As it is known from FIG. 8 and the like, the insertion hole 44 and the coupling window 41 are provided in a region surrounded by the through holes 45.

In the configuration example as well, the magnetic field of the TEM waveguide 10 is coupled in the H plane of the waveguide 30. In the RF module, the magnetic field distributions in the connection portion between the TEM waveguide 10 and the waveguide 30 and in the H plane near the connection portion are as schematically shown in FIG. 8. The magnetic field H1 of the TEM waveguide 10 near the connection portion is distributed, in a manner similar to the first configuration example, mainly near the coupling window 41 provided around the connection portion. On the other hand, assuming a TE mode of the lowest order ($TE_{10}$ mode), the magnetic field H2 of the waveguide 30 is distributed spirally along the wall in the H plane. Therefore, as shown in the diagram, by matching the direction of the magnetic field H1 in the coupling window 41 of the TEM waveguide 10 with the direction of the magnetic field H2 of the waveguide 30 in the H plane of the waveguide 30, the magnetic fields are coupled near the coupling window 41 and the mode is converted from the TEM mode to the TE mode.

As described above, in the RF modules having the configurations, electromagnetic waves in the TEM mode propagate in the TEM waveguide 10 as the first waveguide. The electromagnetic waves in the TEM mode propagate in the second waveguide (the waveguides 20 and 30) for propagating electromagnetic waves in a mode different from the TEM mode. In the connection portion between the first and second waveguides, as shown in FIGS. 3 and 8, in the H plane of the second waveguide, the magnetic fields are coupled so that the direction of the magnetic field H1 of electromagnetic waves propagating in the first waveguide and the direction of the magnetic field H2 of electromagnetic waves propagating in the second waveguide match with each other, thereby converting the TEM mode to another mode.

A method of adjusting the degree of magnetic field coupling will now be described by taking the first configuration example of FIGS. 1, 2 and 3 as an example.

A first adjusting method is a method of adjusting the degree of coupling by a width W of the coupling window 11 (FIG. 3). In this case, when the width W is shortened, the degree of coupling is lowered.

Figure 9A:
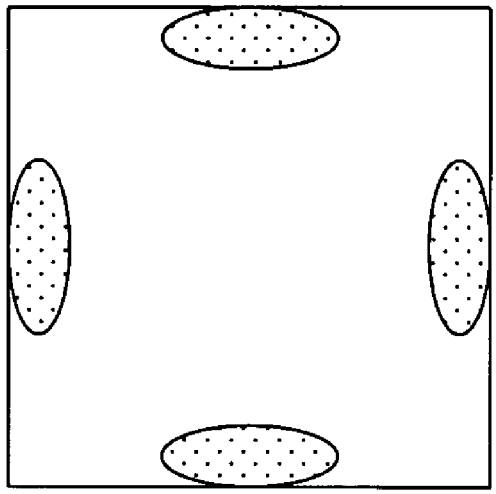
FIGS. 9A and 9B are diagrams each showing an example of a magnetic field distribution in a waveguide having a polygonal shape.
Figure 9B:
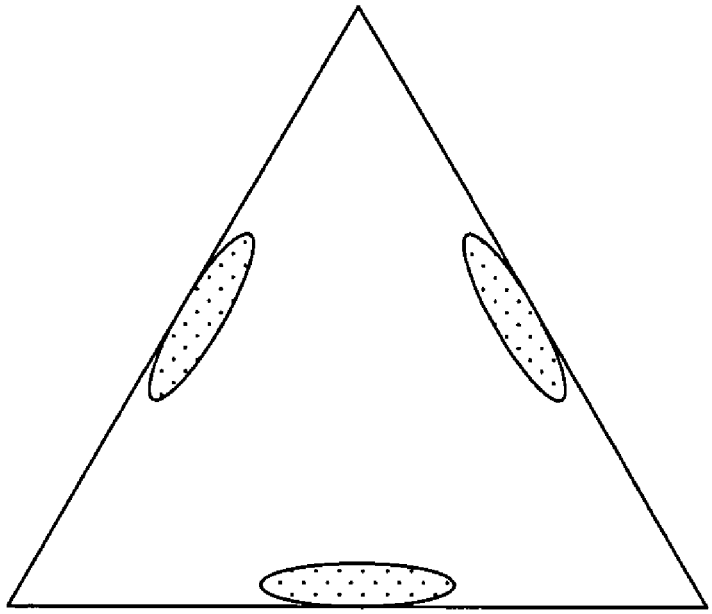

A second adjusting method is a method of adjusting the degree of coupling by the position itself in which the TEM waveguide 10 is connected in consideration of the intensity distribution of the magnetic field in the waveguide 20. As shown in FIGS. 9A and 9B, generally, in a waveguide (cavity resonator) having a polygonal shape, the magnetic field strength becomes the maximum around the center of each of the sides of the polygon shape. FIGS. 9A and 9B show magnetic field distributions in the H plane in waveguides having a square sectional shape and a triangle sectional shape, respectively, in the H plane direction. In each of the diagrams, a hatched region is a region where the magnetic field strength is high.

Figure 4A:
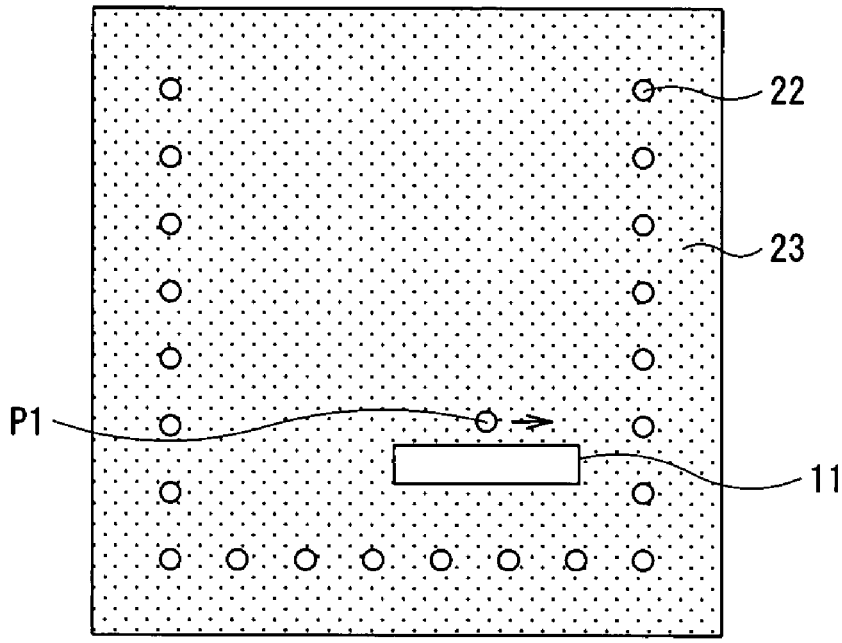
FIGS. 4A and 4B are diagrams illustrating coupling adjustment in the RF module shown in FIG. 1.
Figure 4B:
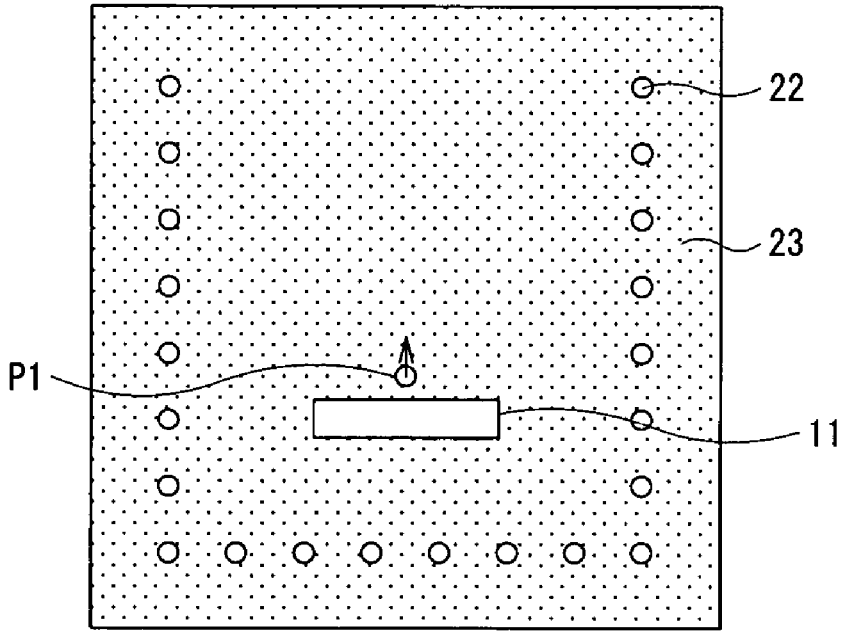

Therefore, as shown in FIG. 3, when the TEM waveguide 10 is connected around the center of a side (side wall formed by the through holes 22) and the coupling window 11 is provided around the connection portion, since the magnetic field strength is high in the position, the degree of coupling is high. On the other hand, when the connection position P1 and the coupling window 11 are moved, for example, in any of the directions shown by the arrows in FIGS. 4A and 4B and the magnetic fields are coupled at a position apart from the center of the side, the degree of coupling is lowered. FIG. 4A shows an example where the connection position P1 and the coupling window 11 are disposed in an end portion of a side, and FIG. 4B shows an example where the connection position P1 and the coupling window 11 are disposed in the center portion of the waveguide.

Figure 5:
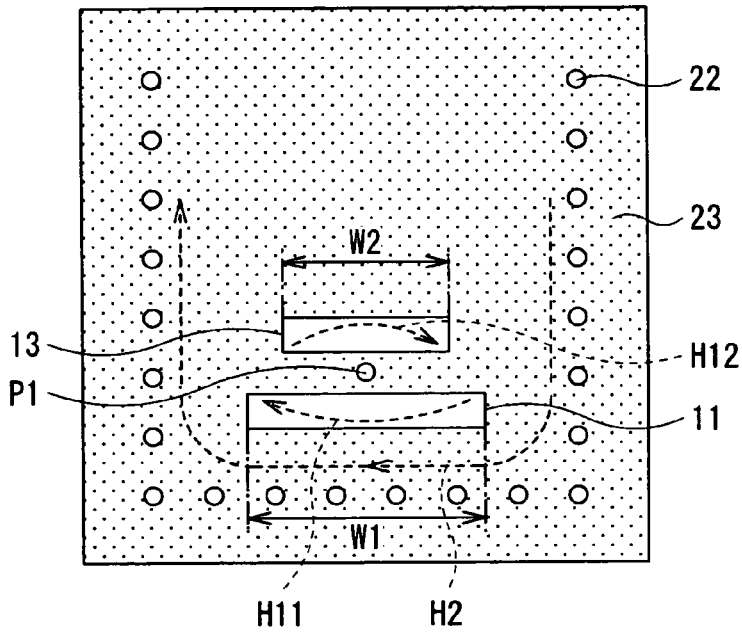
FIG. 5 is a diagram showing another example of coupling adjustment in the RF module illustrated in FIG. 1.

A third adjusting method is, as shown in FIG. 5, a method of separately providing an adjustment window 13 for coupling adjustment in a position different from the coupling window 11. In a manner similar to the coupling window 11, the adjustment window 13 is formed by, for example, partially cutting the ground electrode 23 in a rectangular shape. The adjustment window 13 is disposed, for example, in a position opposite to the coupling window 11 while sandwiching the connection position P1.

In this case, around the connection position P1, the magnetic field generated by the TEM waveguide 10 is distributed mainly near the coupling window 11 and the adjustment window 13. The directions of the magnetic fields H11 and H12 are opposite to each other. Therefore, the direction of the magnetic field H11 in the coupling window 11 matches with that of the magnetic field H2 of the waveguide 20. On the other hand, the direction of the magnetic field H12 in the adjustment window 13 is opposite to the direction of the magnetic field H2 and the magnetic fields act in the direction of canceling off each other.

Therefore, the coupling adjustment can be carried out by adjusting the width W1 of the coupling window 11 and the width W2 of the adjustment window 13. For example, by increasing the width W2 of the adjustment window 13 while leaving the width W1 of the coupling window 11 constant, the coupling is gradually weakened.

The electromagnetic waves propagate from the first waveguide to the second waveguide in the above description. On the contrary, electromagnetic waves may propagate from the second waveguide to the first waveguide.

As described above, according to the embodiment, an end portion of the first waveguide is directly conductively connected to one of the ground electrodes of the second waveguide from the stacking direction side of the ground electrodes, and the directions of the magnetic fields of the first and second waveguides are matched and coupled in the H plane. Thus, mode conversion between the TEM mode and another mode can be excellently performed between the waveguides.

According to the embodiment, the first waveguide is conductively connected directly to the ground electrode or indirectly to the ground electrode of the second waveguide. Consequently, without changing the connection position, the magnetic fields can be coupled at the maximum efficiency in a wide frequency range.

Figure 10A:
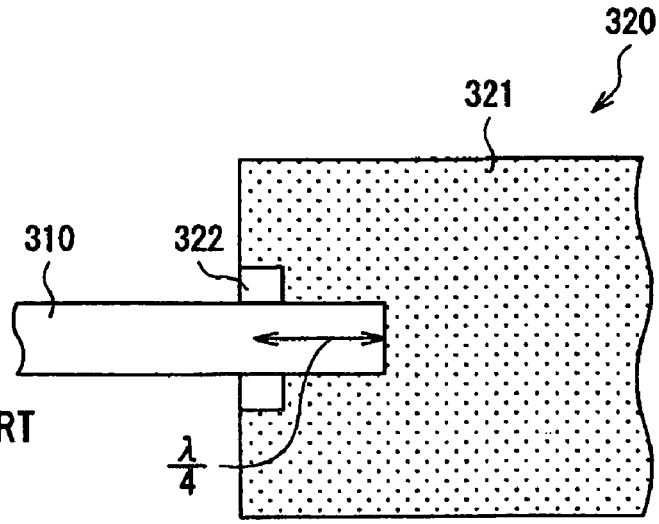
FIG. 10A RELATED ART
FIGS. 10A and 10B are diagrams showing a comparative example of the RF module according to the embodiment of the invention.
Figure 10B:
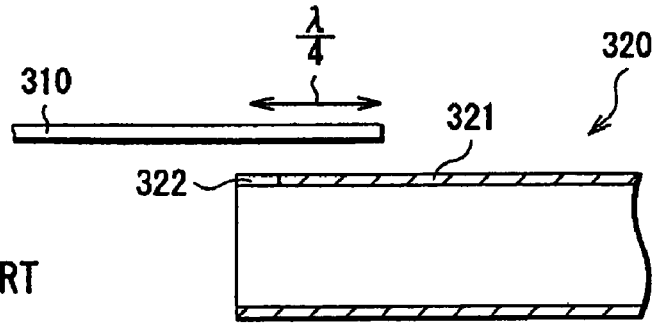
FIG. 10B RELATED ART

This will be described by referring to a mode converting structure as a comparative example shown in FIGS. 10A and 10B. FIG. 10A is a plan view of the mode converting structure and FIG. 10B shows a configuration in a side face direction. In the mode converting structure, a coupling window 322 is formed in a part of a ground electrode 321 in a second waveguide 320. A case of coupling a first waveguide 310 such as a microstrip line whose end is an open end to the second waveguide 320 at the maximum efficiency will be considered. In this case, as shown in the diagrams, by positioning the coupling window 322 at a length of $\lambda/4$ ($\lambda$: signal wavelength) from the open end of the first waveguide 310, the degree of coupling becomes the maximum. However, in the case of such a mode converting structure, to realize coupling at the maximum efficiency, the positional relation between the first waveguide 310 and the coupling window 322 has to be corrected in accordance with signal frequency.

In contrast, in the case of the mode converting structure of the embodiment, the first and second waveguides are directly connected so as to be conductive in the connection portion. Consequently, even if the signal frequency changes, the magnetic fields can be always coupled (mode can be converted) at the maximum efficiency without adjustment of the connection position. That is, the magnetic fields can be coupled at the maximum efficiency in a wide range.

[Modifications]

Modifications of the RF module, and the mode converting structure and method will now be described.

[First Modification]

Figure 11:
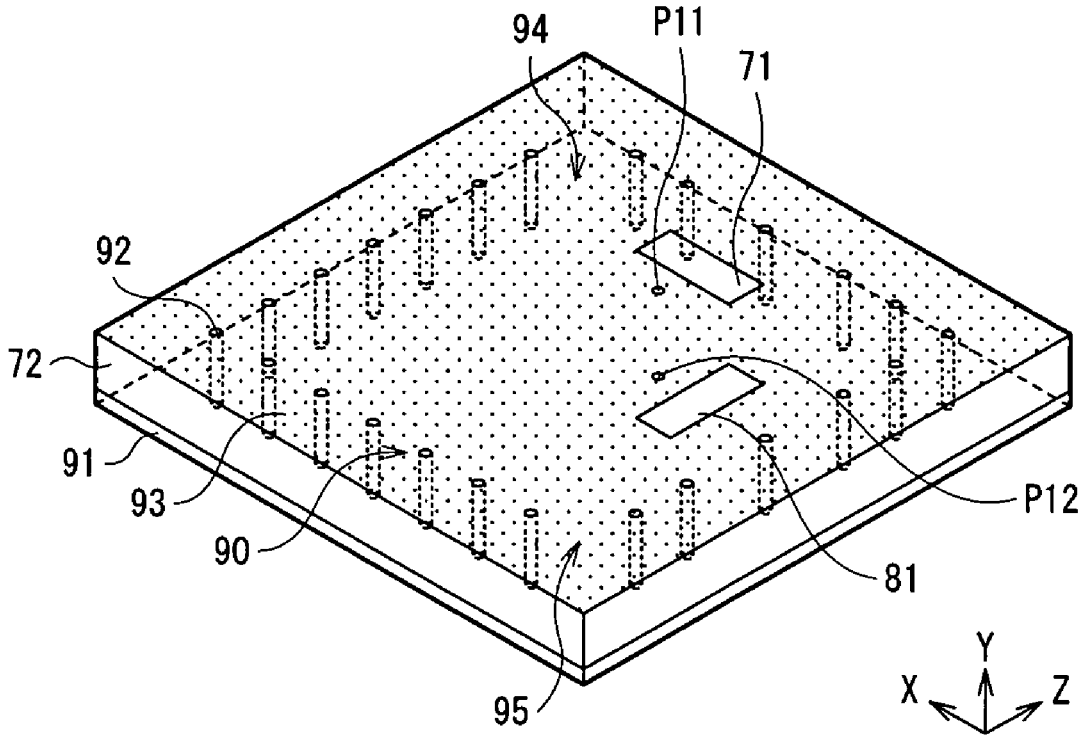
FIG. 11 is a perspective view showing the configuration of an RF module as a first modification.
Figure 12:
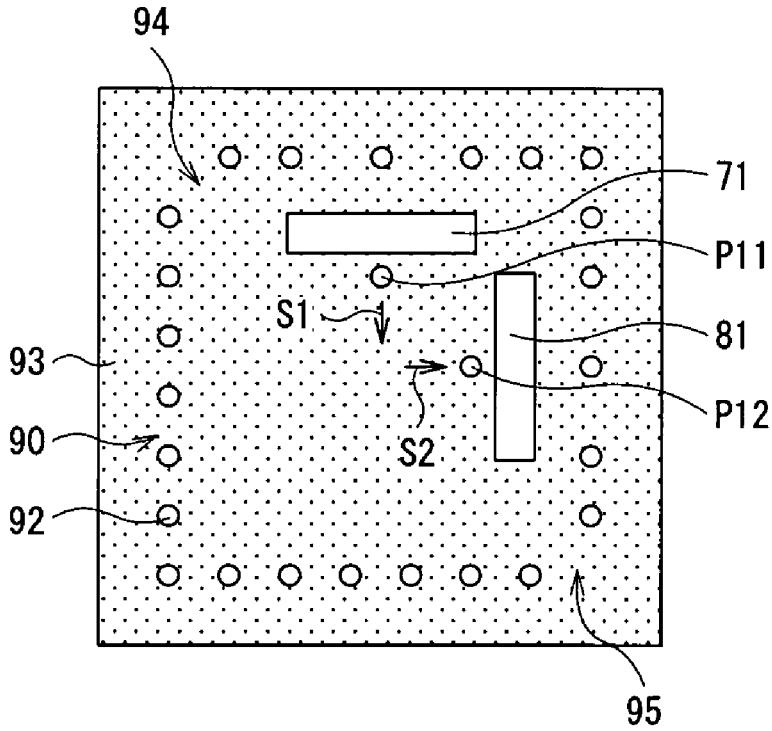
FIG. 12 is a plan view of the RF module shown in FIG. 11.

FIG. 11 shows the configuration of an RF module in a first modification. FIG. 12 is a plan view of the RF module. In FIG. 11, for simplicity of the drawing, the thickness of the uppermost layer is omitted and hatched. In the first modification, a waveguide 90 in a multiple mode (double mode) is used as the second waveguide. In the configuration example, the TEM waveguide 10 is connected to an input/output portion of the waveguide 90 in the double mode.

The waveguide 90 has a dielectric substrate 72, ground electrodes 91 and 93 facing each other, and a plurality of through holes 92 as conductors for bringing the ground electrodes 91 and 93 into conduction. In a region surrounded by the ground electrodes 91 and 93 and the through holes 92, for example, electromagnetic waves propagate in two modes in the directions S1 and S2 in the diagram. The through holes 92 are arranged in, for example, an approximately square shape.

A structure of connecting the TEM waveguide 10 and the waveguide 90 is basically similar to the first configuration example shown in FIGS. 1 to 3. In the waveguide 90, coupling windows 71 and 81 for adjusting coupling to the TEM waveguide 10 are provided near positions P11 and P12 of connection to the TEM waveguide 10. In an example of the drawing, the coupling windows 71 and 81 are provided in the upper ground electrode 93, and the TEM waveguide 10 is connected around the coupling windows 71 and 81. It is also possible to provide the coupling windows 71 and 81 in the lower ground electrode 91 and couple the TEM waveguide 10 to the lower ground electrode 91 side.

In the modification as well, the TEM waveguide 10 extends in the stacking direction (Y direction) of the ground electrodes 91 and 93 of the waveguide 90, and its end is directly connected from the stacking direction side to the ground electrode 93 as one of the ground electrodes and is made conductive. The magnetic field of the TEM waveguide 10 is coupled in the H plane of the waveguide 90. In the modification, for example, a signal is input to the connection position P11 side and a signal is output from the connection position P12 side.

Figure 13A:
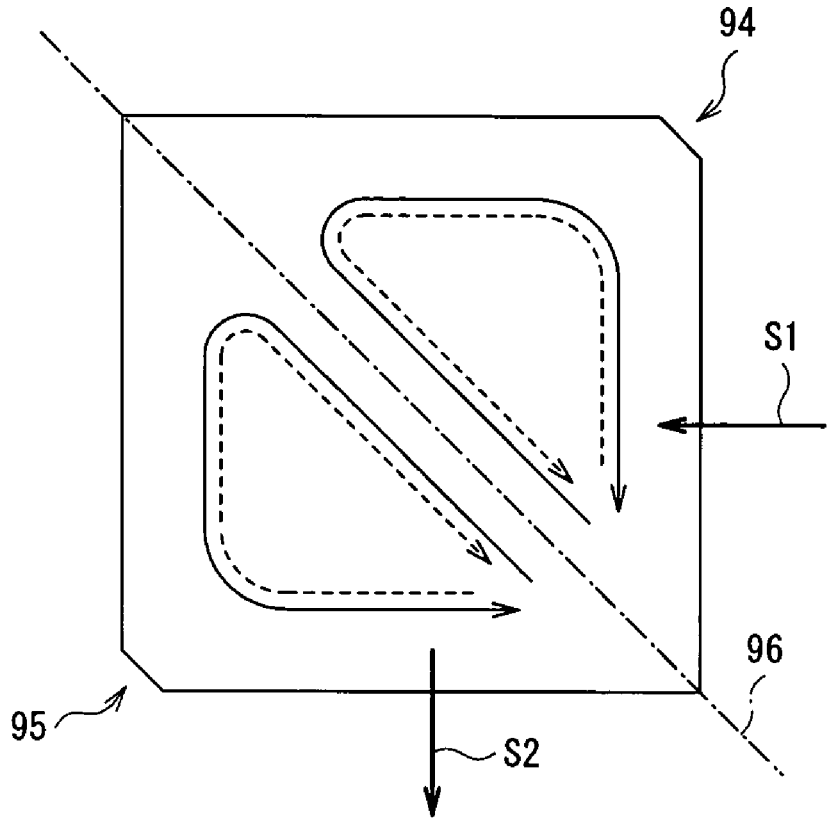
FIGS. 13A and 13B are diagrams each showing a mode of a magnetic field distribution in the RF module illustrated in FIG. 11.
Figure 13B:
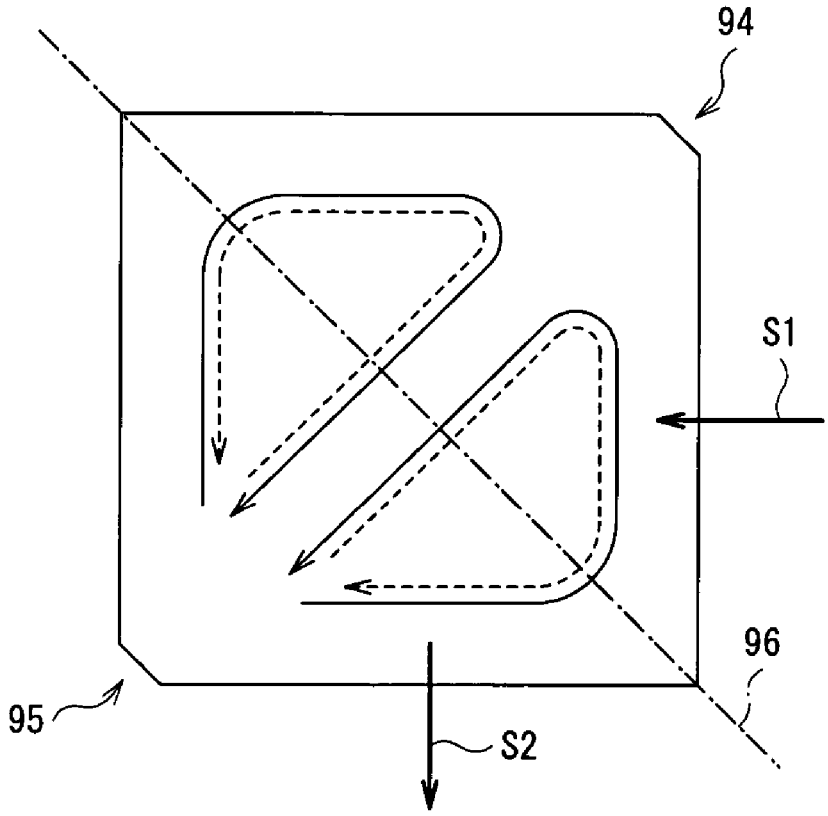

FIGS. 13A and 13B show magnetic field distributions in two modes of the waveguide 90. The waveguide 90 has a first mode (FIG. 13A) in which magnetic fields are distributed in parallel to a structural symmetry plane 96 and a second mode (FIG. 13B) in which magnetic fields are distributed perpendicular to the symmetry plane 96. In the waveguide 90, in positions 94 and 95 on a diagonal line which is orthogonal to the symmetry plane 96, by changing the shape of an electromagnetic wave propagation region, the signal frequency band can be adjusted. For example, by changing the shape of the propagation region to a corner-rounded shape as shown in the diagrams, the bandwidth can be widened.

Figure 14A:
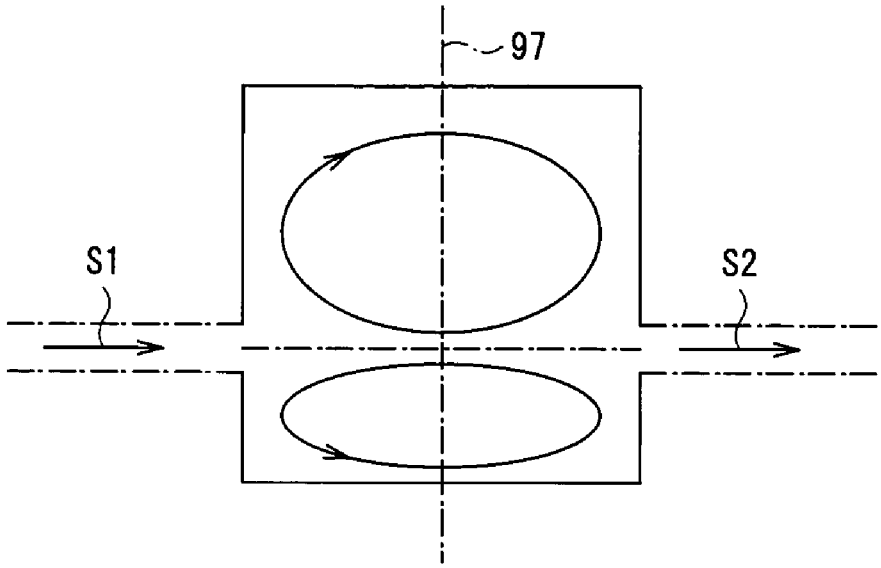
FIGS. 14A and 14B are diagrams illustrating other examples of a double mode.
Figure 14B:
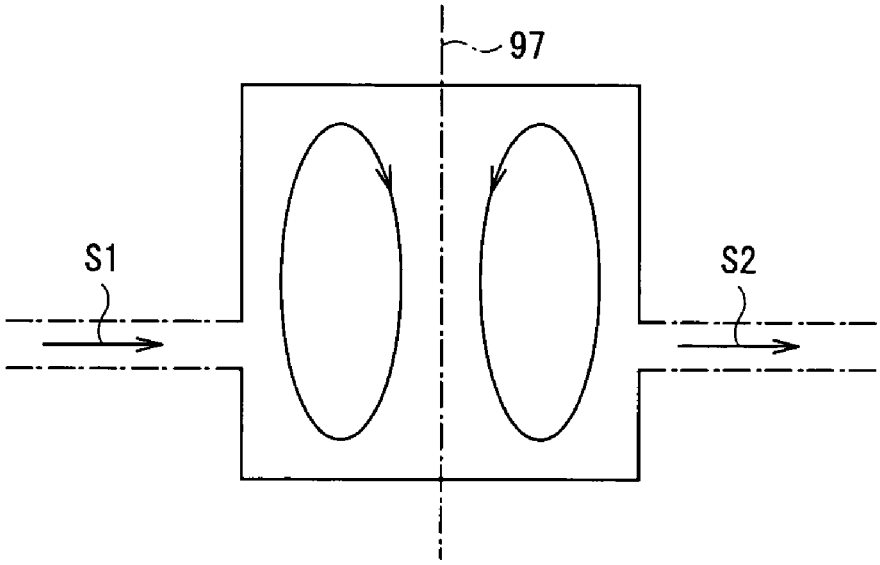

Other than the configuration, the waveguide of the double mode may have various configurations. An example is a waveguide which oscillates in two magnetic field distribution modes as shown in FIGS. 14A and 14B. The waveguide also has a first mode (FIG. 14B) in which magnetic fields are distributed in parallel to a structural symmetry plane 97, and a second mode (FIG. 14A) in which magnetic fields are distributed perpendicular to the symmetrical plane 97. The mode converting structure of the embodiment can be applied also to the double-mode waveguide having other configurations.

As described above, according to the modification, the waveguide of the TEM mode can be connected also to the double-mode waveguide 90 and conversion between the TEM mode and another mode can be carried out.

[Second Modification]

Figure 15:
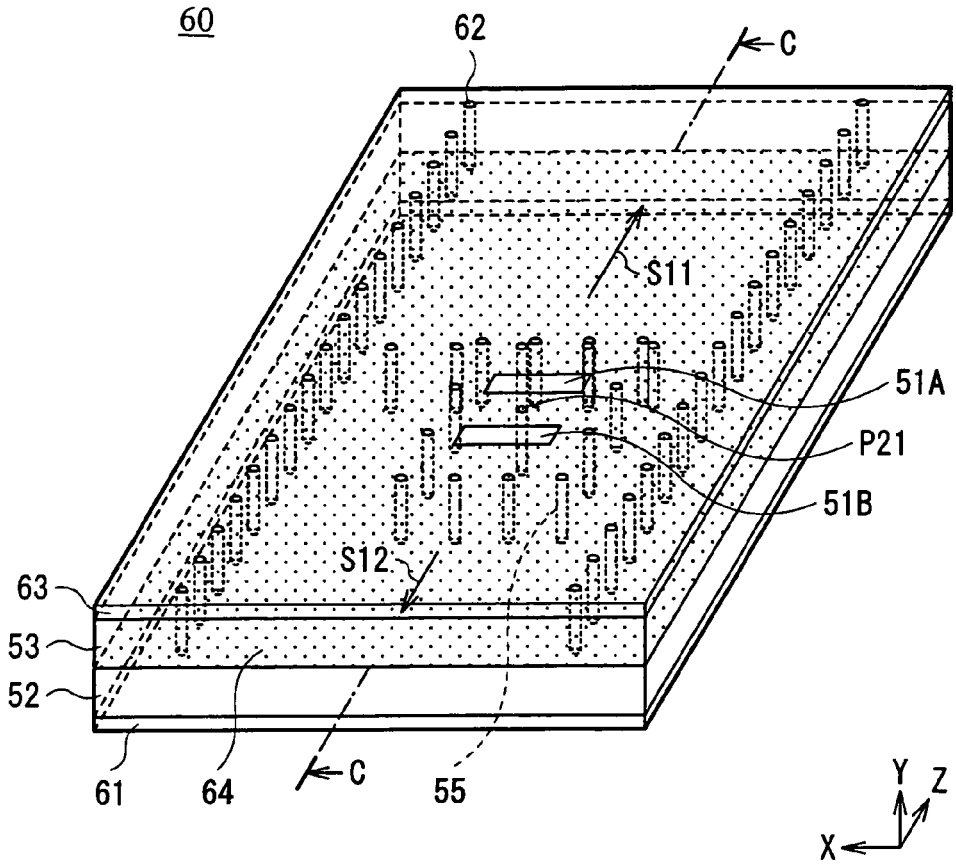
FIG. 15 is a perspective view showing the configuration of an RF module of a second modification.
Figure 16A:
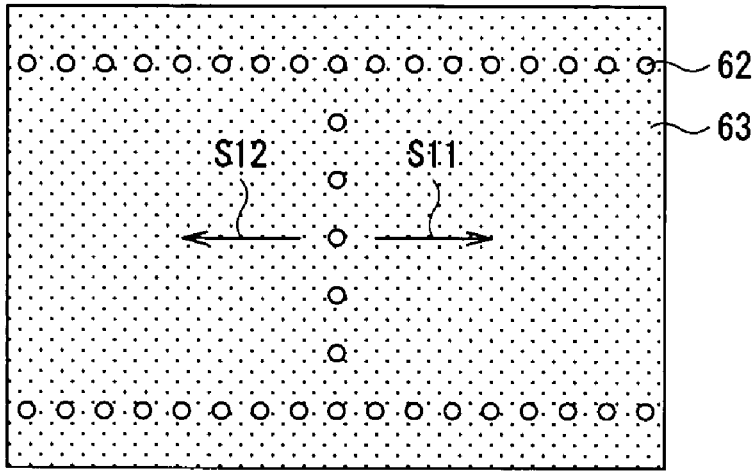
FIGS. 16A, 16B and 16C are plan views showing the configurations of layers in the RF module illustrated in FIG. 15.
Figure 16B:
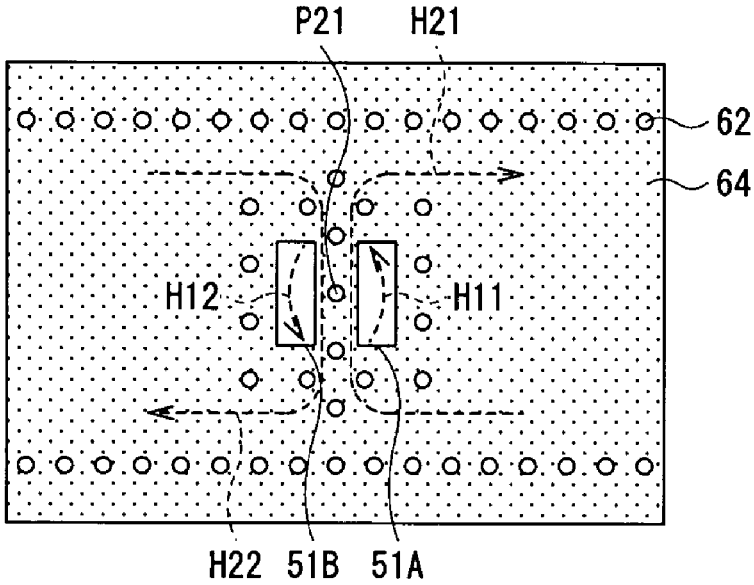
Figure 16C:
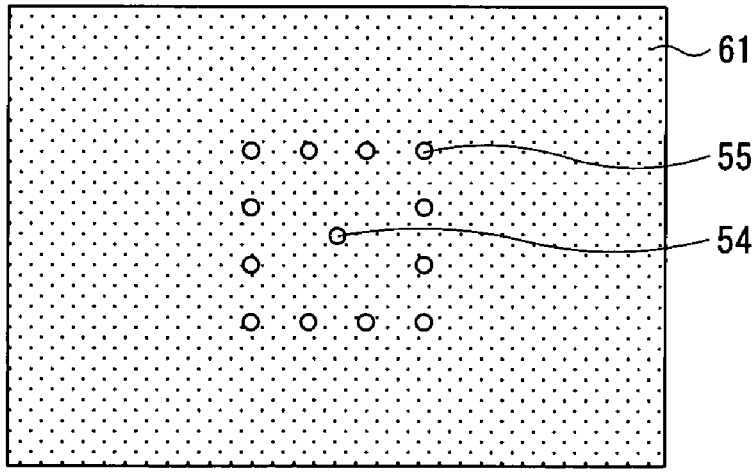
Figure 17:
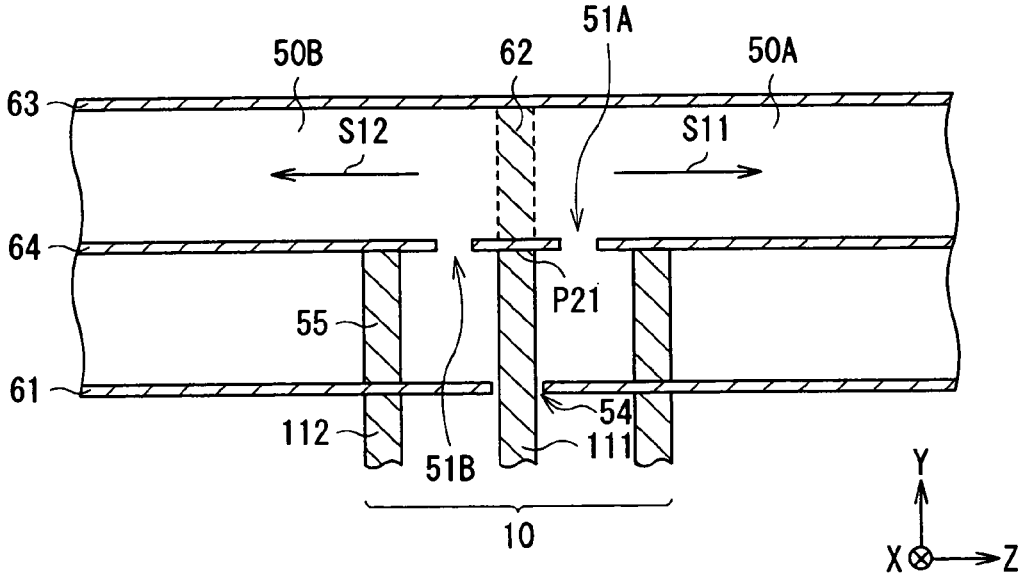
FIG. 17 is a cross section of the RF module shown in FIG. 15.
Figure 18A:
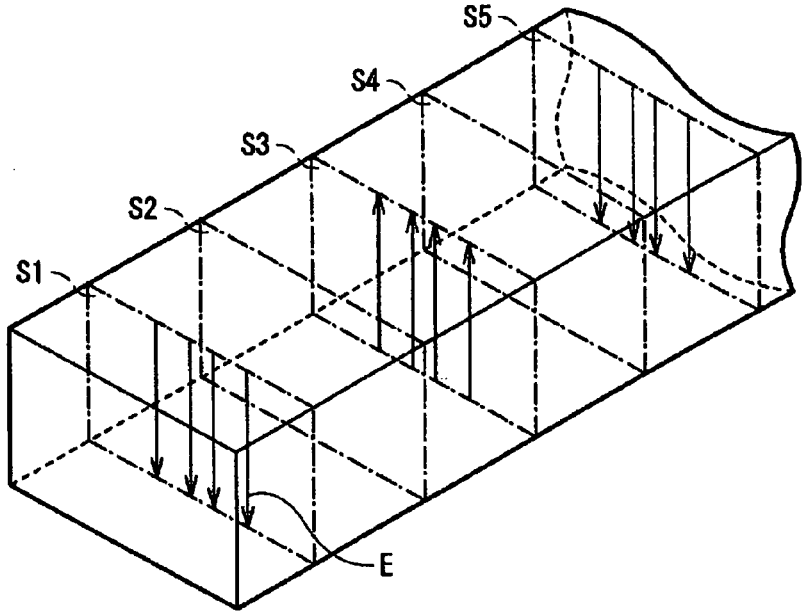
FIG. 18A RELATED ART
FIGS. 18A and 18B are diagrams each showing an electromagnetic field distribution in a waveguide in the TE mode.
Figure 18B:
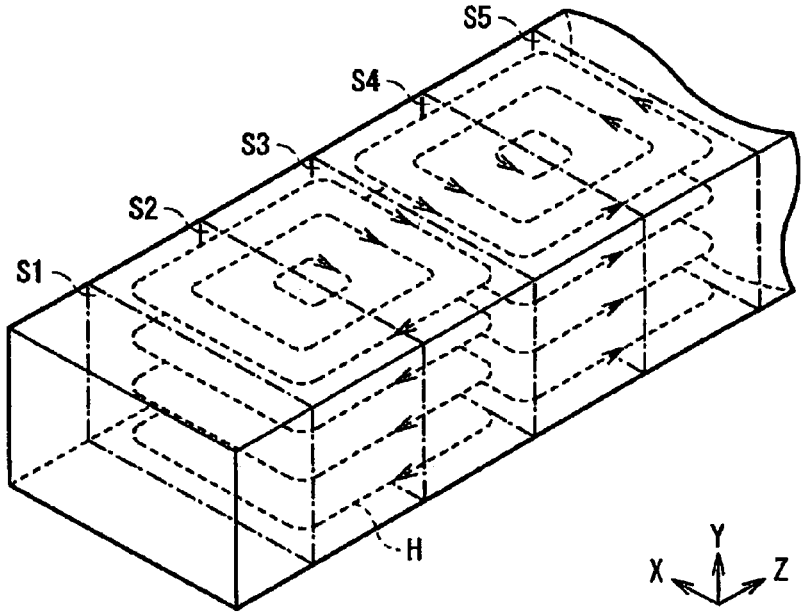
FIG. 18B RELATED ART
Figure 21A:
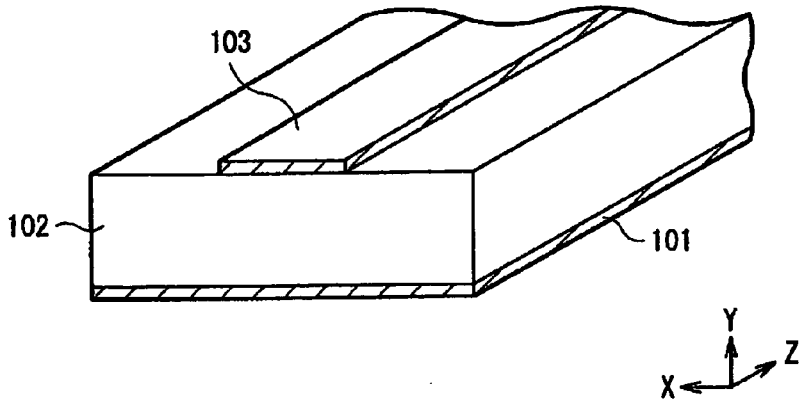
FIG. 21A RELATED ART
FIGS. 21A and 21B are configuration diagrams of a microstrip line and a coaxial line, respectively.
Figure 21B:
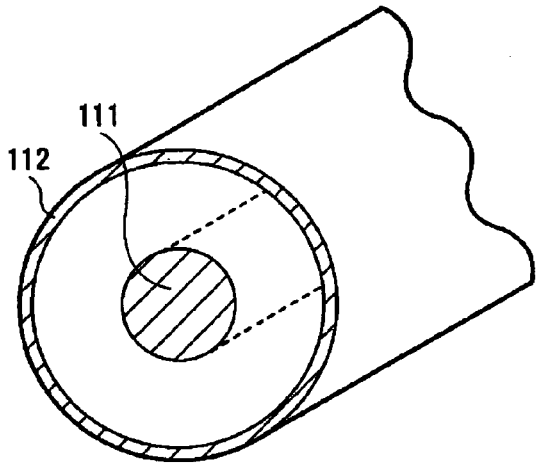
FIG. 21B RELATED ART
Figure 22A:
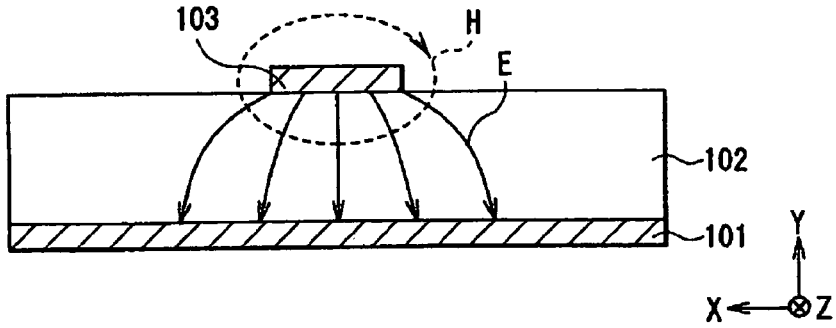
FIG. 22A RELATED ART
FIGS. 22A and 22B are diagrams illustrating electromagnetic field distributions in the TEM mode in the microstrip line and the coaxial line, respectively.
Figure 22B:
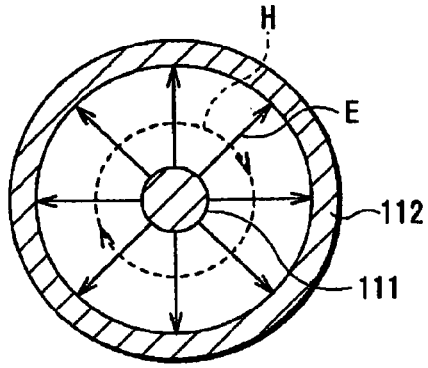
FIG. 22B RELATED ART
Figure 23:
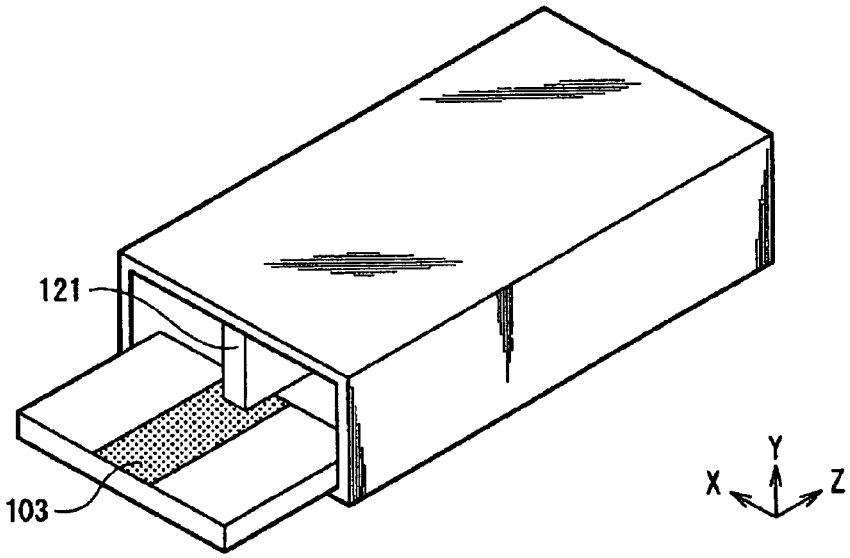
FIG. 23 RELATED ART
FIG. 23 is a perspective view showing an example of a conventional connecting structure of a microstrip line and a waveguide.
Figure 24A:
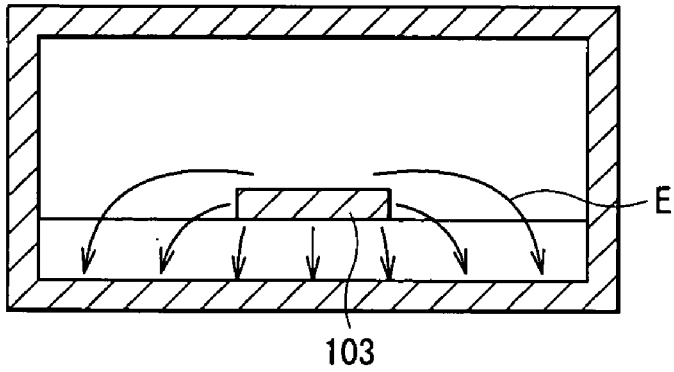
FIG. 24A RELATED ART
FIGS. 24A, 24B and 24C are diagrams each showing an electric field distribution in the connecting structure illustrated in FIG. 23.
Figure 24B:
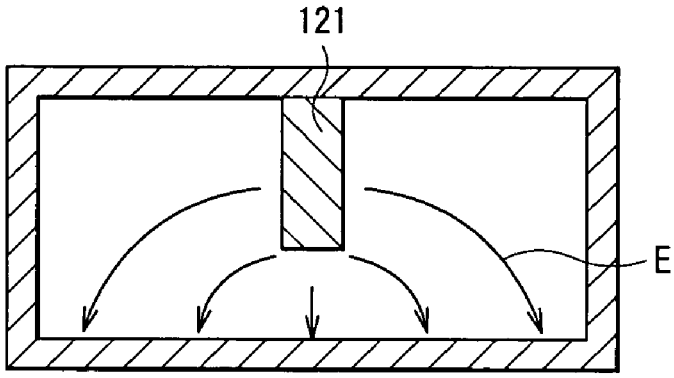
FIG. 24B RELATED ART
Figure 24C:
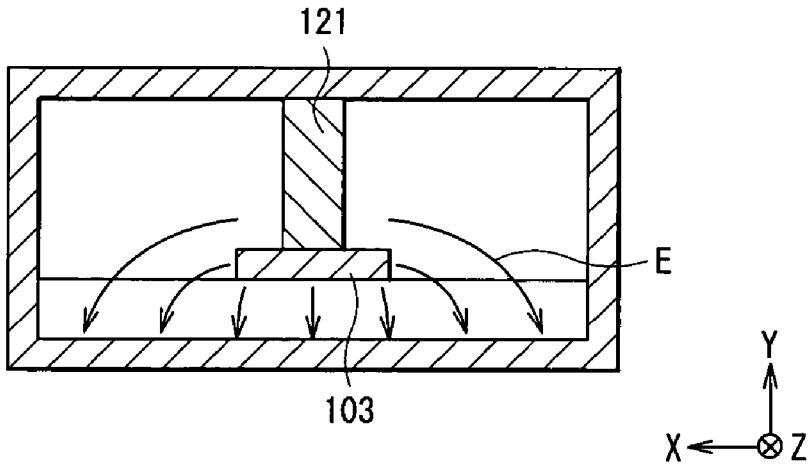
FIG. 24C RELATED ART

FIGS. 15, 16A, 16B, 16C and 17 show the configuration of an RF module according to a second modification. In FIG. 15, to simplify the drawing, the thickness of an intermediate layer is omitted and hatched. FIG. 17 corresponds to a section taken along line C—C of FIG. 15.

The RF module of each of the configuration examples has only one electromagnetic wave propagation region on the second waveguide side. In the modification, a waveguide 60 having a multilayer structure as the second waveguide has a plurality of electromagnetic wave propagation regions.

The waveguide 60 has two dielectric substrates 52 and 53, three ground electrodes 61, 63, and 64 provided on the dielectric substrates 52 and 53 so as to face each other, and a plurality of through holes 55 and 62 as conductors each for bringing at least two ground electrodes of the ground electrodes 61, 63, and 64 into conduction. The lower ground electrode 61 is uniformly provided on the bottom face of the lower dielectric substrate 52. The upper ground electrode 63 is uniformly provided on the top face of the upper dielectric substrate 53. The intermediate ground electrode 64 is provided between the dielectric substrates 52 and 53. FIGS. 16A, 16B and 16C are plan views showing the configuration of the lower ground electrode 61, intermediate ground electrode 64, and upper ground electrode 63.

The through holes 55 and 62 are provided at intervals of a certain value or less (for example, ¼ of the signal wavelength or less) so that the propagating electromagnetic waves are not leaked. The inner face of each of the through holes 55 and 62 is metalized. The sectional shape of each of the through holes 55 and 62 is not limited to a circular shape but may be another shape such as a polygon shape or an oval shape. The through hole 62 brings the upper ground electrode 63 and the intermediate ground electrode 64 into conduction. The through hole 55 brings the lower ground electrode 61 and the intermediate ground electrode 64 into conduction. The through holes 62 are disposed, for example, in an H shape between the upper and intermediate ground electrodes 63 and 64. The through holes 55 are disposed, for example, so as to surround the position P21 of connection to the TEM waveguide 10.

In the waveguide 60, in two propagation regions 50A and 50B surrounded by the upper and intermediate ground electrodes 63 and 64 and through holes 62, electromagnetic waves propagate in the different directions S11 and S12. The waveguide 60 may have a configuration of a dielectric waveguide in which the electromagnetic wave propagation regions 50A and 50B are filled with a dielectric or a configuration of a cavity waveguide having therein a cavity.

In the configuration example, the TEM waveguide 10, which includes a central conductor 111 and a cylindrical ground conductor 112, extends in the stacking direction (Y direction) of the ground electrodes 61, 63, and 64 of the waveguide 60 and its end portion, which includes the central conductor 111, is directly connected to the intermediate ground electrode 64 from the stacking direction side via the lower ground electrode 61 and is made conductive. In the lower ground electrode 61, an insertion hole 54 in which the TEM waveguide 10 is inserted is provided. In the intermediate ground electrode 64, coupling windows 51A and 51B for coupling adjustment are provided near the position P21 of connection to the TEM waveguide 10. Each of the coupling windows 51A and 51B is formed by partially cutting the intermediate ground electrode 64, for example, in a rectangular shape. The insertion hole 54 and the coupling windows 51A and 51B are provided in a region surrounded by the through holes 55.

Also in the modification, the connection position P21 is set in the boundary portion of the two propagation regions 50A and 50B in the intermediate ground electrode 64. The coupling window 51A is provided in a position corresponding to the first propagation region 50A, and the coupling window 51B is provided in a position corresponding to the second propagation region 50B. By the structures, the magnetic fields of the TEM waveguide 10 are coupled in the H plane of each of the two propagation regions 50A and 50B, and the electromagnetic waves propagating the TEM waveguide 10 are branched into the two propagation regions 50A and 50B and propagate.

Specifically, as shown in FIG. 16B, around the connection position P21, the magnetic fields generated by the TEM waveguide 10 are distributed mainly near the coupling windows 51A and 51B. The directions of the magnetic fields H11 and H12 are opposite to each other. In the connection portion, when the directions of the magnetic fields H21 and H22 in the propagation regions 50A and 50B of the waveguide 60 are set so as to be the same as those of the magnetic fields H11 and H12 of the TEM waveguide 10, respectively, the magnetic fields are coupled excellently in the H plane of each of the propagation regions 50A and 50B and the TEM mode is converted to another mode.

In the modification, an RF signal propagated in the TEM mode can be branched into a plurality of signals and propagated in another mode. The mode converting structure of the modification can be suitably used for a duplexer or the like.

The invention is not limited to the foregoing embodiments but can be variously modified. Although the example of using through holes as a structure for bringing the ground electrodes in the second waveguide into conduction has been described in the foregoing embodiments, a conductor having a structure different from the through hole may be also employed. For example, a configuration may be employed in which a groove-shaped structural portion is provided in place of the through hole and the inner face of the groove is metalized to form a metal wall. Such a metal wall can be formed by, for example, a micromachining method.

As described above, in the RF module and the mode converting structure and method according to the invention, an end of the first waveguide is directly conductively connected to one of the ground electrodes of the second waveguide from the stacking direction side, and magnetic fields of the first and second waveguides are coupled in an H plane of the second waveguide so that the direction of the magnetic field of electromagnetic waves propagated in the first waveguide and that of the magnetic field of electromagnetic waves propagated in the second waveguide match with each other. Thus, between waveguides, mode conversion between the TEM mode and another mode can be excellently performed.

Obviously many modifications and variations of the present invention are possible in the light of the above teachings. It is therefore to be understood that within the scope of the appended claims, the invention may be practiced otherwise than as specifically described.

What is claimed is:

1. An RF module, comprising:

a first waveguide having a ground electrode and a line-shaped conductor portion for propagating electromagnetic waves in a TEM mode; and a second waveguide connected to the first waveguide, for propagating electromagnetic waves in another mode different from the TEM mode, wherein the second waveguide has a region surrounded by at least two ground electrodes stacked in a vertical direction so as to face each other and conductors for bringing the at least two ground electrodes into conduction, wherein electromagnetic waves in said another mode propagate in the region, and a connecting window is provided in one of the at least two ground electrodes, the first waveguide extends in a stacking direction of the at least two ground electrodes of the second waveguide, an end of the first waveguide is short-circuited and conductively connected to the one of the at least two ground electrodes of the second waveguide at a periphery of the connecting window, and magnetic fields of the first and second waveguides are coupled in an H plane of the second waveguide so that the direction of the magnetic field of electromagnetic waves propagated in the first waveguide and the direction of the magnetic field of electromagnetic waves propagated in the second waveguide match with each other.

2. An RF module according to claim 1, wherein the second waveguide is to propagate electromagnetic waves in a TE mode.

3. An RF module according to claim 1, wherein the second waveguide is to propagate the electromagnetic waves of the another mode in a multiple mode.

4. An RF module according to claim 1, wherein the second waveguide defines a structure including a plurality of propagation regions for propagating electromagnetic waves in different directions, the plurality of the propagation regions each having the H-plane, the end of the first waveguide is short-circuited and conductively connected to boundary portions of the plurality of propagation regions of the second waveguide, and the magnetic field of the first waveguide is coupled in the H plane in the plurality of propagation regions in the second waveguide.

5. An RF module according to claim 4, wherein the end of the first waveguide is short-circuited and conductively connected to the boundary portions of the plurality of propagation regions of the second waveguide so that said electromagnetic waves propagated through the first waveguide propagate so as to be branched into the plurality of propagation regions in the second waveguide.

* * * * *